United States Patent [19]

Stromberg

[11] 4,364,477

[45] Dec. 21, 1982

[54] PLASTICS FISH BOX

[76] Inventor: Per S. Stromberg, Raelingen N-2000, Lillestrom, Norway

[21] Appl. No.: 916,428

[22] Filed: Jun. 16, 1978

[30] Foreign Application Priority Data

Jun. 17, 1977 [DK] Denmark ..... 2689/77
May 31, 1978 [GB] United Kingdom ..... 24878/78

[51] Int. Cl.[3] ..... B65D 21/02

[52] U.S. Cl. ..... 206/511; 220/72; 220/74; 220/94 A

[58] Field of Search ..... 220/94 A, 74; 206/509, 206/511, 557, 507, 567

[56] References Cited

U.S. PATENT DOCUMENTS 2,619,251 11/1952 Schmidt ..... 220/94 A
3,005,572 10/1961 Gustafson et al. ..... 220/94 A
3,197,058 7/1965 Hale ..... 206/507
3,361,290 1/1968 Matthews ..... 220/94 A
3,741,433 6/1973 Bentley et al. ..... 220/94 A
3,902,599 9/1975 Stromberg ..... 206/511
3,907,111 9/1975 Levenhagen ..... 206/511
3,938,691 2/1976 Dumas ..... 220/94 A

*Primary Examiner*—Joseph Man-Fu Moy
*Attorney, Agent, or Firm*—Sughrue, Mion, Zinn, Macpeak & Seas

[57] ABSTRACT

A plastics fish box for use on board fishing boats at sea is described. The fish box has a bottom, and side and end walls of substantially uniform thickness which terminate in a rim around the upper edge of the box. The lower parts of the walls are formed without contour, while the upper portions have a wave-shaped contour region to define with the rim a plurality of handgrip recesses.

4 Claims, 7 Drawing Figures

PLASTICS FISH BOX

BACKGROUND OF THE INVENTION

1. Field of the Invention

This invention relates to plastics boxes, and in particular to so-called "fish boxes" for use on board fishing boats at sea for receiving freshly caught fish. When the fishing boat returns to port the catch is handled by means of the fish boxes.

2. Prior Art

Plastics materials lend themselves to the production of boxes of various configurations by moulding. Numerous varieties of plastics boxes have been proposed for particular purposes. The desires of substantial structural strength on the one hand and lightness in weight and simplicity of construction on the other hand are frequently competitive. Heretofore, various designs of boxes for different purposes have arrived at different compromises between these two desires.

It has been proposed, for example, to shape plastics boxes, and in particular containers intended to be both stackable and nestable, with corrugated side and end walls so that the side and end walls have a somewhat wave-shaped contour in horizontal section. U.S. Pat. No. 3,052,373 of Frater (1962) and U.S. Pat. No. 3,270,913 of Bridenstine et al (1966) are typical of such prior containers. The principal purpose for the construction adopted was so that with two identical containers in the same orientation placed upon each other, the two containers would be nestable whereas reversing the relative orientation by 180° causes the containers to be stackable rather than nestable.

The containers of Frater and of Bridenstine et al are primarily intended for the transport of relatively lightweight and easily damaged foodstuffs to retail outlets. It will be appreciated that fish boxes are utilised in very different circumstances and in very much more harsh environments. Fish boxes require substantial structural strength. The boxes must be capable of being placed alongside each other and of being stacked upon each other so that as much as possible of the interior of the hold of a fishing vessel may be utilised. Additionally, the boxes should also be capable of being readily cleaned, as for example by being flushed with water.

While attempts have been made to shape fish boxes also with corrugated side and end walls rather in the manner of U.S. Pat. Nos. 3,052,373 and 3,270,913, the resultant constructions have not been sufficiently acceptable. The corrugated construction provides a more intimate contact between adjacent boxes in the hold of a fishing vessel since the corrugation projection of the side wall of one box may be inserted into the corresponding corrugation trough in the side wall of an adjacent box. Additionally, this construction achieved a certain improvement in resistance of the box to sudden impacts, as frequently occur while in use in a fishing hold or in removing the catch to the quayside. However, it was found that the corrugated surfaces which were employed, having comparatively narrow flutes, tended to damage the fish in the boxes. The design was accordingly rejected.

With other previously proposed fish boxes, the wall thickness, and thus the weight of the box, needed to be substantial unless special measures were taken to reinforce the walls, for example by providing them with bracing elements which themselves required additional plastics material and also resulted in abrupt changes in the surface making it difficult to keep the boxes clean.

A common resort to provide structural strength to the boxes, has been the provision of reinforced uprights in the edges between the side and end walls. While it was found that such reinforced edge portions provided the structural strength if boxes were stacked one upon the other, the wall portions intermediate the edges did not possess adequate strength.

There is an evident need for an improved fish box achieving good strength/weight ratio without a need for corner reinforcements and which nevertheless enables easy cleaning and ready stacking.

An additional problem for prior designers of fish boxes has been the provision of an adequate hand grip. A common expedient has been to provide a through aperture in each end wall both for manual handling and for the insertion of machine elements in mechanical handling. This has frequently proved disadvantageous since, in order to preserve freshly caught fish at sea, it is a common practice to partially fill the box with fish and to place a layer of ice on top of the fish. With through hand holds, the ice is exposed to air and will melt readily at ambient temperatures above freezing.

The aforementioned problems and disadvantages inherent in the previously proposed fish boxes can be readily overcome by the use of preferred embodiments of fish boxes constructed in accordance with the present invention, as will become clear from the detailed description which follows.

STATEMENT OF THE INVENTION

In a first aspect thereof, this invention provides a fish box for use on board fishing boats at sea, the fish box being formed of a plastics material, and having:

a bottom;

side and end walls upstanding from the bottom and defining an upper edge to the box;

a rim which extends around the said upper edge and in which the side and end walls terminate;

the side and end walls being formed with a wave-shaped contour region, and defining together with the rim a plurality of hand grip recesses;

the side and end walls being formed with a substantially uniform thickness of material throughout;

the wave-shaped contour region being confined to respective upper portions of the side and end walls which are adjacent the rim; and the remaining lower portions of the side and end walls being smoothly formed without contour.

Preferably those parts of the upper portions of the side and end walls which lie between the respective recesses are formed as continuations of the said lower portions and merge into and form the outer extremity of the rim. In this construction, the rim is inwardly turned so that no portion of the box extends sideways beyond the lower portion of the side walls and no portion of the box extends end wise beyond the lower portions of the end walls.

As the side and end walls are formed with a substantially uniform thickness of material throughout, the above described preferred construction results in inside surfaces of the box being inwardly bulged at positions corresponding to the said recesses, the inner edge of the rim suitably terminating at said inwardly bulged inside surfaces, whereby structural strength is conferred to the rim by the walls of the box in said recessed and inwardly bulged portions.

In preferred embodiments of the box, the top face of the rim is provided with support and engagement means and the underneath surface of the bottom of the box is provided with corresponding projection means, the support and engagement means and the projection means being adapted to co-operate, whereby boxes may be stacked vertically one upon another in true vertical alignment or may be somewhat offset laterally from vertical alignment.

The invention is hereinafter more particularly described by way of example only with reference to the accompanying drawings.

DETAILED DESCRIPTION OF THE PREFERRED EMBODIMENT

Figure 1:
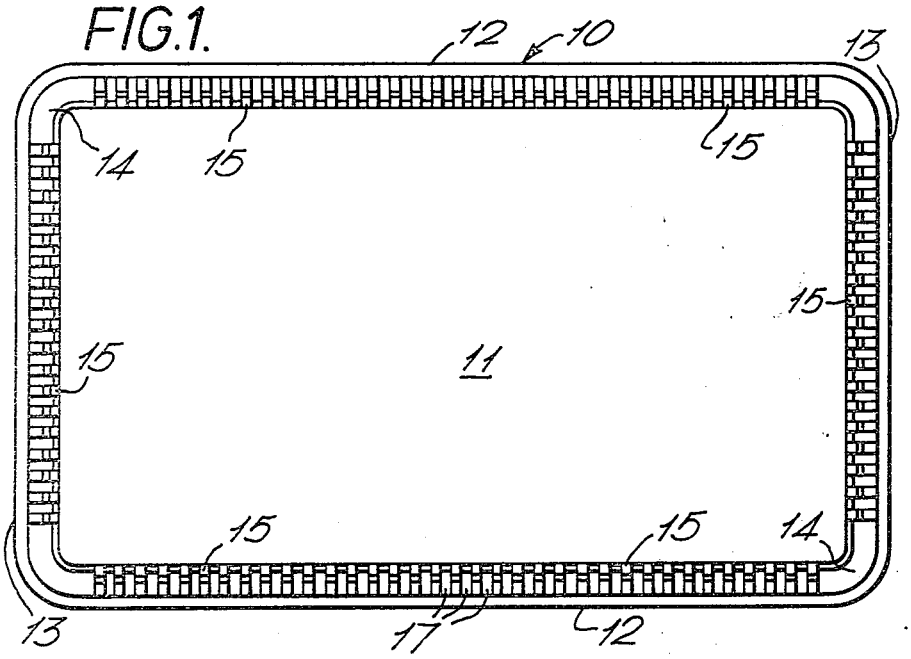
FIG. 1 is a top plan view of a preferred embodiment of fish box constructed in accordance with the present invention.
Figure 2:
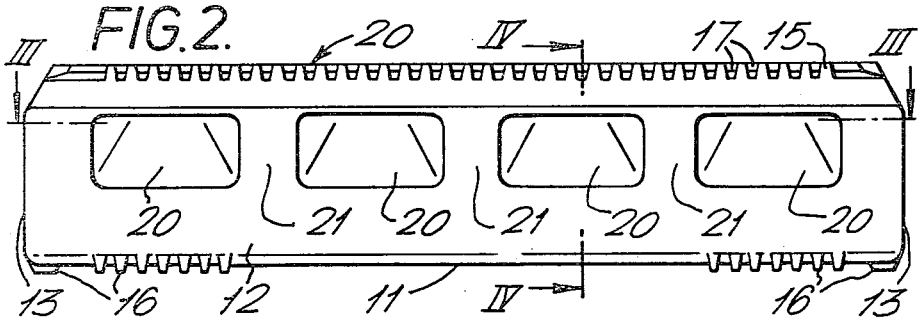
FIG. 2 is a side elevational view of the fish box of FIG. 1.

The illustrated box 10 has a bottom 11 and upstanding side walls 12 and end walls 13.

The side and end walls terminate in a rim 14 which extends around the upper edge of the box. As will be clear from the drawing, the rim is inwardly turned so that no portion of the box extends sideways beyond the side walls 12 and no portion of the box extends end-wise beyond the end walls 13. The top surface of the rim 14 is provided with support and engagement means 15 in the form of respective rows of somewhat tooth-like projections 15. As will become clear from the description which follows, these support and engagement means are adapted to co-operate with corresponding projection means 16 formed on the underneath surface of the bottom 11 of the box.

Figure 3:
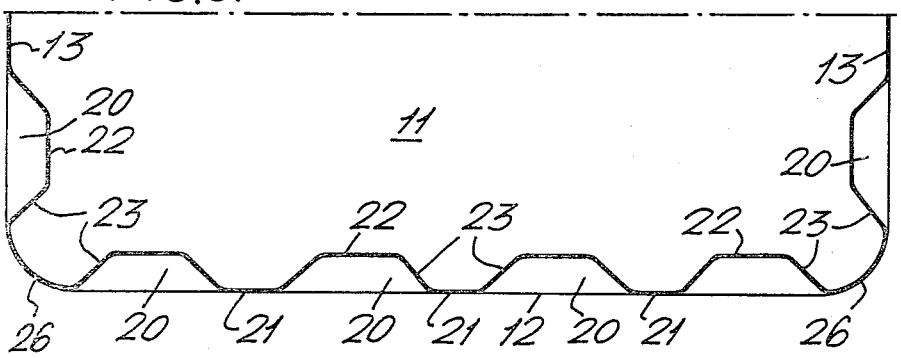
FIG. 3 is a partial sectional view taken along the line III—III in FIG. 2.

As will also be clear from the drawing, a wave-shaped contour region is formed in the side and end walls and defines together with the rim a plurality of hand-grip recesses 20. The wave-shaped contour region is confined to respective upper portions of the side and end walls 12, 13 which are adjacent the rim 14. The parts 21 of the upper portions of the side and end walls 12, 13 which lie between the respective recesses 20 are formed as continuation of the lower portions of the side and end walls respectively, and moreover merge into and form the outer extremity of the rim 14. As will be clear from the drawings, and in particular from FIGS. 4, 5 & 6, the various surfaces which together serve to define each recess 20 are rounded at their edges so as to smoothly merge one into the other. In this way, no sharp edges are created so the cleaning is relatively easy. Wall 22 at the trough of the recess has a relatively small extent compared with the area defined by the recess at the outer surface of the box. This is because the recess side walls 23 slope inwardly towards the recess trough 22 and because the recess bottom wall 24 slopes upwardly towards the recess trough 22. Thus, as is best shown in FIG. 3, the side and end walls have a wave-shaped contour region in horizontal section. The recesses constitute the troughs of the wave-like contour and the undisturbed wall portions 21 correspond to the peaks of the wave-like contour. The rounded corner edges 26 of the box correspond to wave-contour peaks.

As will be clear, particularly from FIGS. 3 to 6, because the side and end walls are formed with a substantially uniform thickness of materials throughout, the inside surfaces of the box are inwardly bulged at positions corresponding to the recesses 20. All the internal surfaces of the box are smooth (apart, that is, from drainage holes or slots such as those shown at 27 in FIGS. 6 and 7 which may be provided to allow water to drain out when the boxes are cleaned and left to dry).

Figure 4:
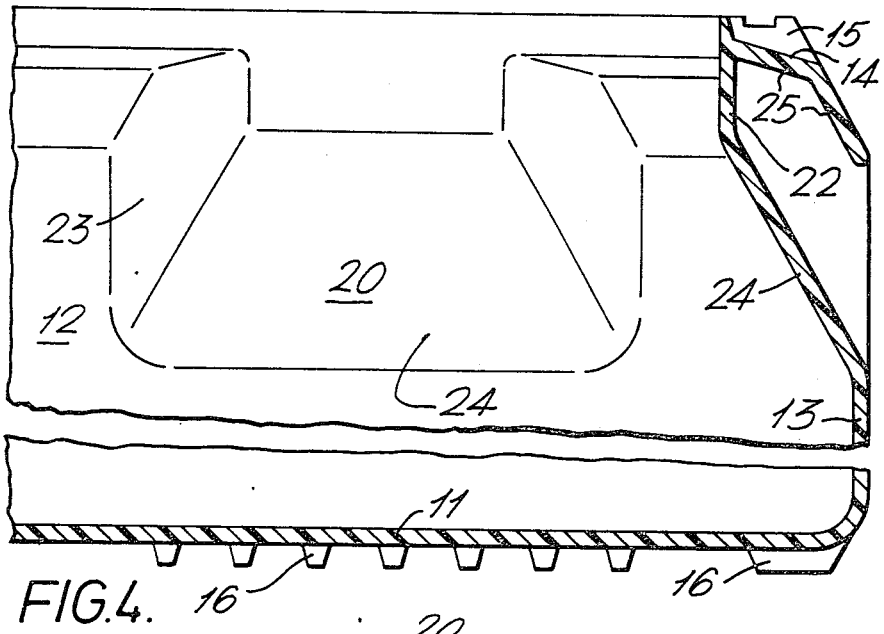
FIG. 4 is a partial sectional view on a larger scale taken along the line IV—IV in FIG. 2.

As will be seen from FIG. 4, the inner edge of the rim 14 terminates at the inwardly bulged inner surfaces corresponding to the positions of the recesses. The configuration of the rim, which is most apparent from FIG. 4, the outer extremity of which smoothly merges into the parts 21 of the upper portions of the side and end walls which lie between the recesses, and the inner edge of which teminates at the inwardly bulged inner surfaces corresponding to the recesses, results in a construction of substantial structural strength. Moreover, that the rim is both inwardly turned and upwardly configured as shown in FIG. 4 means that convenient hand-grip surfaces 25 are formed on its under surface at the recesses.

Figure 5:
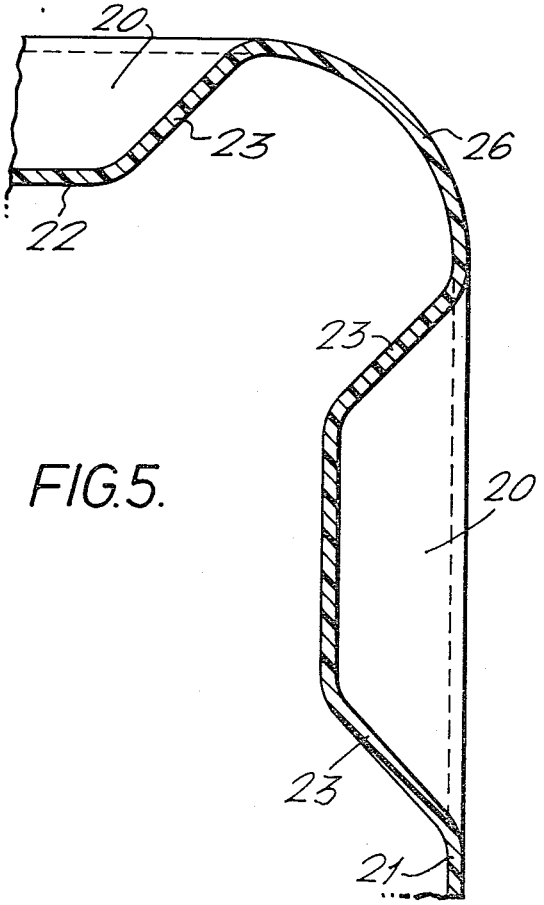
FIG. 5 is a view to a similar scale corresponding to one corner portion of FIG. 3.

Turning now to FIG. 5, it will be noted that the construction of a corner edge of the box results in a wall portion 26 and two inwardly directed wall portions 23 in the upper part of the box together with the rim 14 which overlies all three such wall portions and further merges into the adjacent wall portions 22 of the recesses 20 respectively in the side and end walls adjacent the corner edge concerned. This construction provides considerable strength to the corner edge without requiring a reinforced upright.

It will of course be well understood that the side walls and end walls need not necessarily respectively have three and two recesses respectively but may have any convenient number. However, we have found that the particular construction illustrated represents a good compromise in design. The more recesses present, the greater will the strength be as also the greater will be the material required. As the number of recesses increases so does the possibility for damage to the fish.

The shape of the wave-shape contour can be varied somewhat. It would be feasible, for example, for the contour to take the shape of a sine curve proper. It is found, however, that the illustrated embodiment is relatively straightforward to mould.

Figure 6:
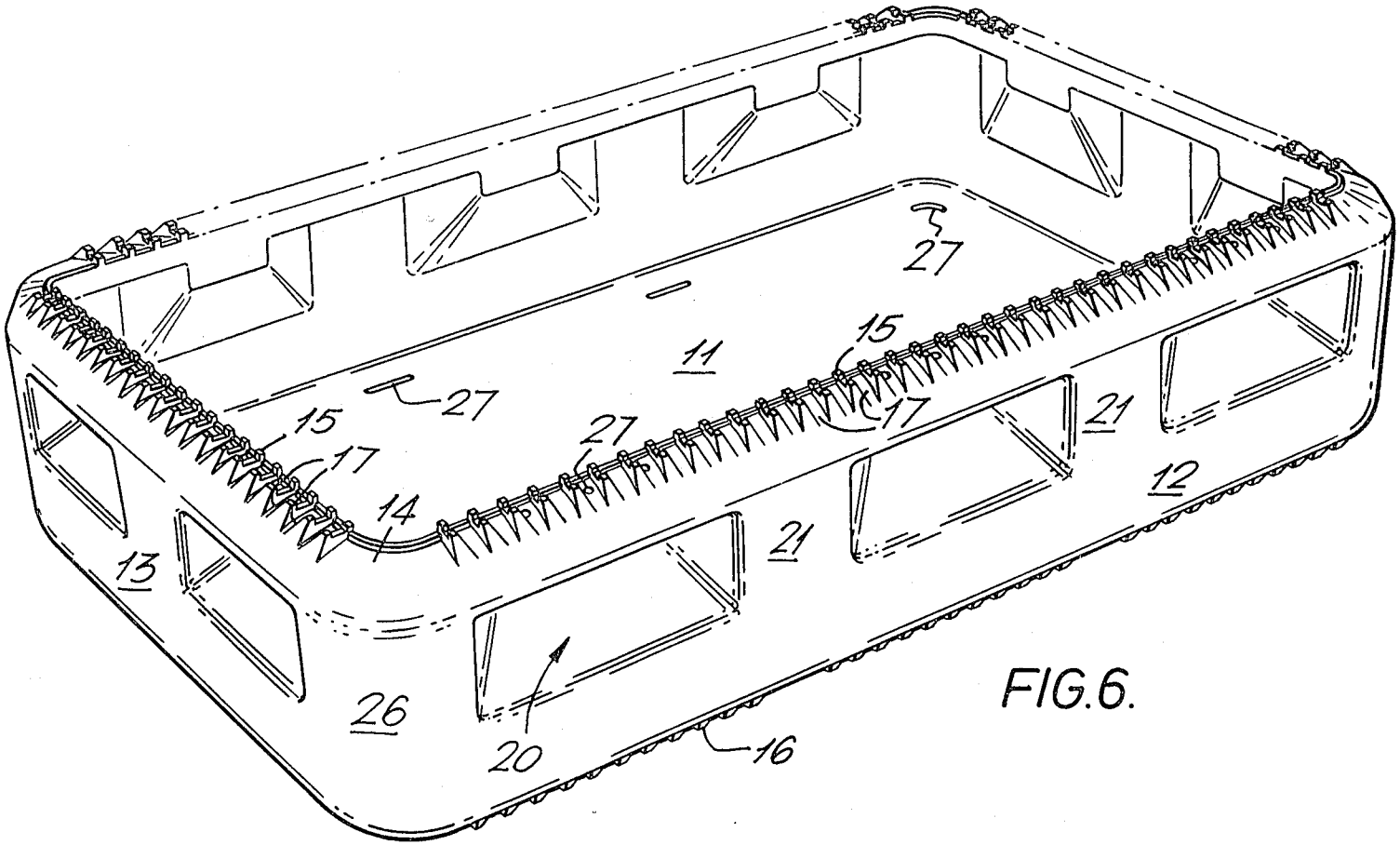
FIG. 6 is an overall perspective view of the fish box of FIGS. 1 to 5.
Figure 7:
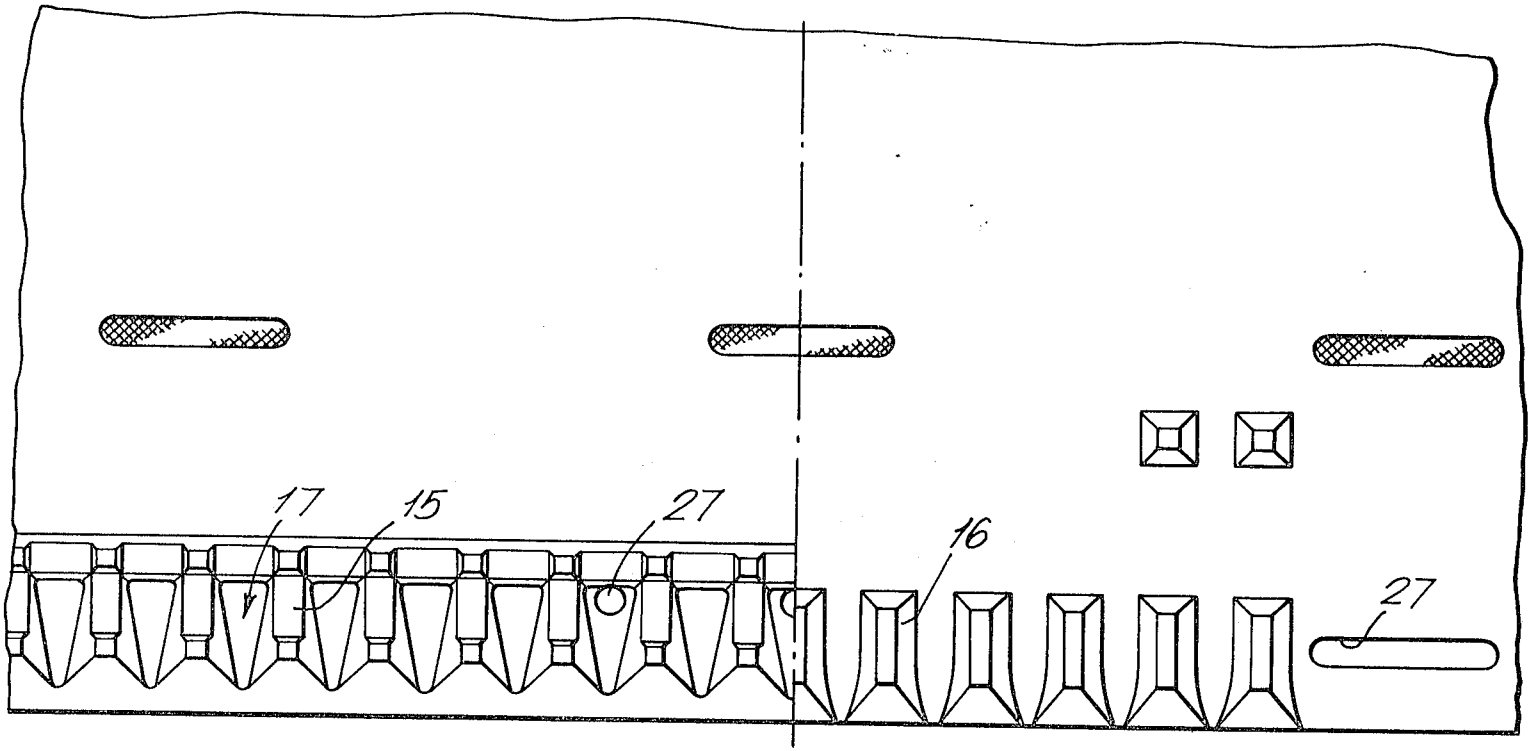
FIG. 7 is an enlarged view in plan illustrating on the left hand side thereof support and engagement means on the top face of the rim of the box, and on the right hand side thereof the corresponding projection means formed on the underneath surface of the bottom of the box, whereby to show the manner of their co-operation.

As can clearly be seen in FIG. 6, a plurality of tooth-like projections 15 extend upwardly from the top surface of the rim to provide support and engagement means for a second box stacked on top of the first. These projections 15 may also be seen in other figures. The details thereof can best be seen in FIG. 7. FIG. 7 also shows the co-operating corresponding projection means 16 which extend downwardly from the underneath surface of the bottom 11 of the box. When inter-engaged, each bottom projection 16 enters the space 17 intermediate a pair of the tooth-like projections 15. It will be noted, particularly from FIG. 7, that both the bottom projection 16 and the tooth-like rim projections 15 have sloping sides. This is to ensure that the projections can readily be disengaged from each other, as by lifting one end of a superposed box and then sliding it endwise over the edge of the other. The notched upper edge of each tooth-like projection 15 which is best apparent from FIG. 6 also serves to reduce the total area of contact between two boxes making separation easier.

Previously proposed fish boxes generally required that when they were stacked, they were stacked in direct vertical alignment if the strengthened portions of the box were not to bear against a relatively insubstantial portion on the box beneath. With the described and illustrated embodiment of the fish box constructed in accordance with the present invention, boxes need not be stacked in direct vertical alignment but may be somewhat offset laterally relative to each other. Provided that the projections means formed on the underneath surface of a particular box are in co-operation with corresponding projection means formed on the rim(s) of one or two boxes below, and provided that a position of stable equilibrium is achieved, all will be well. It follows that the use of fish boxes as described and illustrated in detail enables boxes to be stacked in the hold of a fishing vessel making best use of the total volume of the hold which will usually be defined by concave inner wall faces.

It will readily be appreciated that the description given above is by way of example only and that numerous variations may be made for particular embodiments. The invention is defined in the claims which follow.

What is claimed is:

1. A fish box for use on board fishing boats at sea, the fish box being formed of plastics material, and having:

(a) a bottom;

(b) side and end walls upstanding from the bottom and defining an upper edge to the box;

(c) a rim which extends around the said upper edge and in which the side and end walls terminate;

(d) the side and end walls being formed with a wave-shaped contour region, the wave-shaped contour region and the rim together serving to define a plurality of hand-grip recesses;

(e) the side and end walls, including edge regions thereof serving to define corner edge regions of the box, being of substantially the same thickness throughout and being formed with a substantially uniform thickness of material;

(f) the wave-shaped contour region being confined to respective upper portions of the side and end walls which are adjacent the rim; and (g) the remaining lower portions of the side and end walls being smoothly formed without contour.

2. A fish box according to claim 1, wherein parts of the upper portions of the side and end walls which lie between the respective recesses are formed as continuations of the said lower portions and merge into and form the outer extremity of the rim, and wherein the rim is inwardly turned so that the box is wholly contained within the space defined in plan by the lower portions of the side and end walls.

3. A fish box according to claim 2, wherein the recesses define inwardly bulged portions on the inside surfaces of the box, the rim having an inner edge which terminates at said inwardly bulged inside surface portions, structural strength being conferred to the rim by the walls of the box in said recessed and inwardly bulged portions.

4. A fish box according to claim 1, wherein the rim has a top face, and wherein support and engagement means are formed on said top face; corresponding projection means being formed on the underneath surface of the bottom of the box whereby said box may be stacked upon another box of like structure with the support and engagement means in co-operation with the projection means with the boxes stacked in any position from vertically one upon another in vertical alignment to somewhat offset laterally from such vertical alignment.

* * * * *